US005881915A

United States Patent [19]

Smrz

[11] Patent Number: 5,881,915

[45] Date of Patent: Mar. 16, 1999

[54] PERSONAL DEFENSE SPRAY DELIVERY SYSTEM

[76] Inventor: Frank A. Smrz, 821 N. Lamb Blvd. #5D, Las Vegas, Nev. 89110

[21] Appl. No.: 26,148

[22] Filed: Feb. 19, 1998

[51] Int. Cl.[6] ..... E05G 5/00

[52] U.S. Cl. ..... 222/78; 109/20

[58] Field of Search ..... 222/3, 5, 78, 394; 109/20, 32; 239/208

[56] References Cited

U.S. PATENT DOCUMENTS 1,462,781 7/1923 Babiarz ..... 239/208 X
1,645,131 10/1927 Garey ..... 109/20
4,841,752 6/1989 Fletcher ..... 109/20
4,867,076 9/1989 Marcone ..... 109/20
5,655,461 8/1997 Gilbert ..... 109/20

*Primary Examiner*—Gregory L. Huson

[57] ABSTRACT

A new personal defense spray delivery system for delivering a spray of a defensive chemical to an area. The inventive device includes a reservoir of a personal defense chemical. At least one nozzle is in fluid communication with the reservoir. The nozzle is designed for delivering a spray of the personal defense chemical to an area. A delivery device is provided for delivering the personal defense chemical from the reservoir to the nozzle. A first actuator is operatively connected to the delivery device. The first actuator is designed for activating the delivery device.

1 Claim, 2 Drawing Sheets

PERSONAL DEFENSE SPRAY DELIVERY SYSTEM

BACKGROUND OF THE INVENTION

1. Field of the Invention

The present invention relates to delivery systems for defensive chemical sprays and more particularly pertains to a new personal defense spray delivery system for delivering a spray of a defensive chemical to an area.

2. Description of the Prior Art

The use of delivery systems for defensive chemical sprays is known in the prior art. More specifically, delivery systems for defensive chemical sprays heretofore devised and utilized are known to consist basically of familiar, expected and obvious structural configurations, notwithstanding the myriad of designs encompassed by the crowded prior art which have been developed for the fulfillment of countless objectives and requirements.

Known prior art delivery systems for defensive chemical sprays include U.S. Pat. No. 4,118,691; U.S. Pat. No. 5,280,268; U.S. Pat. No. 5,182,541; U.S. Pat. No. 4,301,947; U.S. Pat. No. 5,298,878; and U.S. Pat. No. 4,903,863.

While these devices fulfill their respective, particular objectives and requirements, the aforementioned patents do not disclose a new personal defense spray delivery system. The inventive device includes a reservoir of a personal defense chemical. At least one nozzle is in fluid communication with the reservoir. The nozzle is designed for delivering a spray of the personal defense chemical to an area. A delivery device is provided for delivering the personal defense chemical from the reservoir to the nozzle. A first actuator is operatively connected to the delivery device. The first actuator is designed for activating the delivery device.

In these respects, the personal defense spray delivery system according to the present invention substantially departs from the conventional concepts and designs of the prior art, and in so doing provides an apparatus primarily developed for the purpose of delivering a spray of a defensive chemical to an area.

SUMMARY OF THE INVENTION

In view of the foregoing disadvantages inherent in the known types of delivery systems for defensive chemical sprays now present in the prior art, the present invention provides a new personal defense spray delivery system construction wherein the same can be utilized for delivering a spray of a defensive chemical to an area.

The general purpose of the present invention, which will be described subsequently in greater detail, is to provide a new personal defense spray delivery system apparatus and method which has many of the advantages of the delivery systems for defensive chemical sprays mentioned heretofore and many novel features that result in a new personal defense spray delivery system which is not anticipated, rendered obvious, suggested, or even implied by any of the prior art delivery systems for defensive chemical sprays, either alone or in any combination thereof.

To attain this, the present invention generally comprises a reservoir of a personal defense chemical. At least one nozzle is in fluid communication with the reservoir. The nozzle is designed for delivering a spray of the personal defense chemical to an area. A delivery device is provided for delivering the personal defense chemical from the reservoir to the nozzle. A first actuator is operatively connected to the delivery device. The first actuator is designed for activating the delivery device.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new personal defense spray delivery system apparatus and method which has many of the advantages of the delivery systems for defensive chemical sprays mentioned heretofore and many novel features that result in a new personal defense spray delivery system which is not anticipated, rendered obvious, suggested, or even implied by any of the prior art delivery systems for defensive chemical sprays, either alone or in any combination thereof.

It is another object of the present invention to provide a new personal defense spray delivery system which may be easily and efficiently manufactured and marketed.

It is a further object of the present invention to provide a new personal defense spray delivery system which is of a durable and reliable construction.

An even further object of the present invention is to provide a new personal defense spray delivery system which is susceptible of a low cost of manufacture with regard to both materials and labor, and which accordingly is then susceptible of low prices of sale to the consuming public, thereby making such personal defense spray delivery system economically available to the buying public.

Still yet another object of the present invention is to provide a new personal defense spray delivery system which provides in the apparatuses and methods of the prior art some of the advantages thereof, while simultaneously overcoming some of the disadvantages normally associated therewith.

Still another object of the present invention is to provide a new personal defense spray delivery system for delivering a spray of a defensive chemical to an area.

Yet another object of the present invention is to provide a new personal defense spray delivery system which includes a reservoir of a personal defense chemical. At least one nozzle is in fluid communication with the reservoir. The nozzle is designed for delivering a spray of the personal defense chemical to an area. A delivery device is provided for delivering the personal defense chemical from the reservoir to the nozzle. A first actuator is operatively connected to the delivery device. The first actuator is designed for activating the delivery device.

Still yet another object of the present invention is to provide a new personal defense spray delivery system that Focus 1: may be placed in many various structures including a store counter, or even a vehicle such as a taxi.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
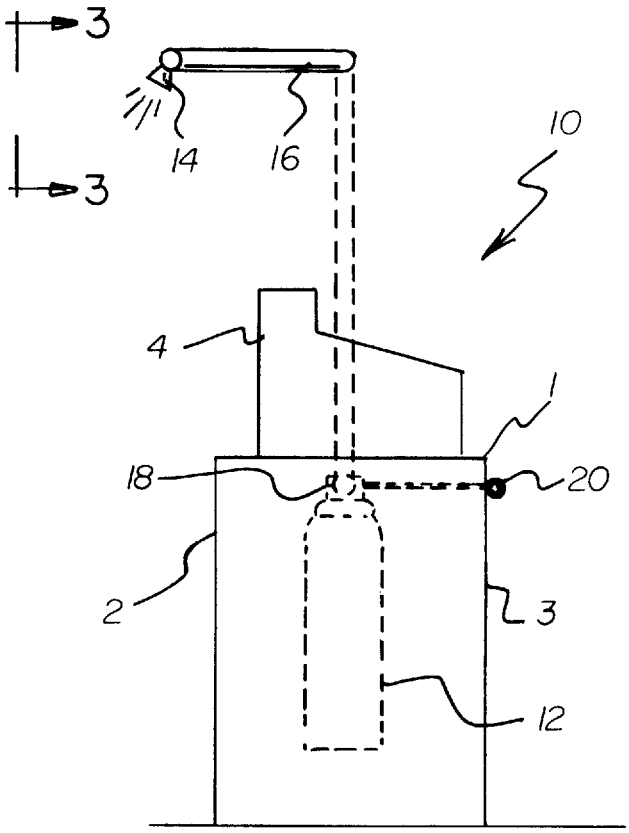
FIG. 1 is a schematic side view of a new personal defense spray delivery system according to the present invention.

With reference now to the drawings, and in particular to FIGS. 1 through 4 thereof, a new personal defense spray delivery system embodying the principles and concepts of the present invention and generally designated by the reference numeral 10 will be described.

As best illustrated in FIGS. 1 through 4, the personal defense spray delivery system 10 generally comprises a reservoir 12 of a personal defense chemical. At least one nozzle 14 is in fluid communication with the reservoir 12. The nozzle 14 is designed for delivering a spray of the personal defense chemical to an area. A delivery device 18 is provided for delivering the personal defense chemical from the reservoir 12 to the nozzle 14. A first actuator 20 is operatively connected to the delivery device 18. The first actuator 20 is designed for activating the delivery device 18.

Figure 2:
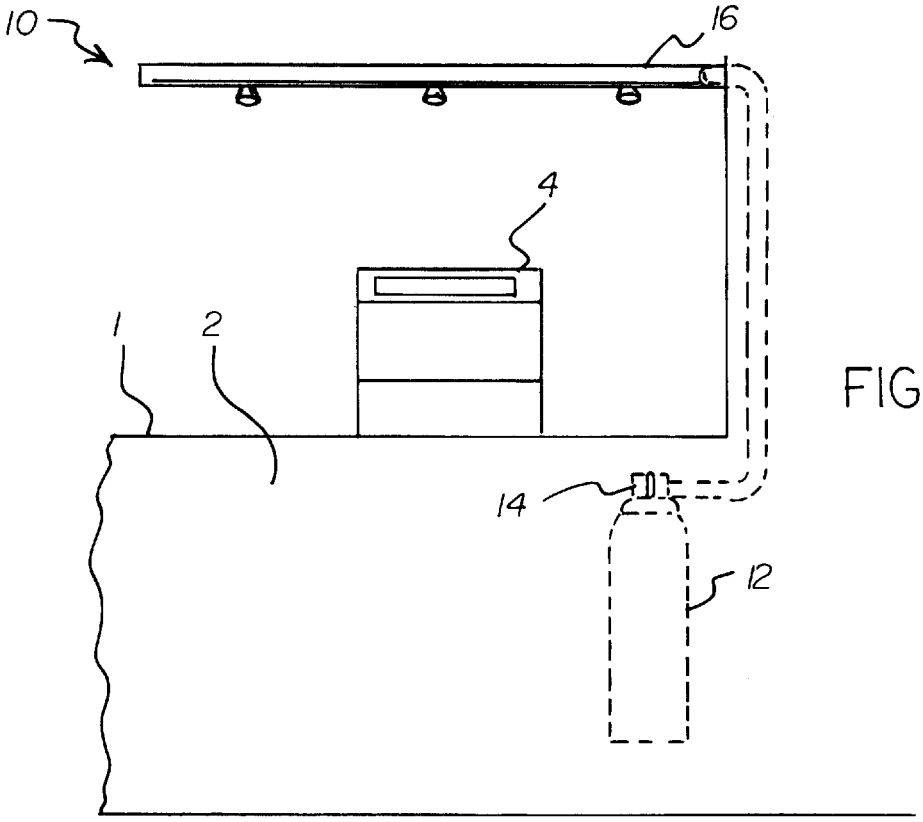
FIG. 2 is a schematic front side view of the present invention.
Figure 3:
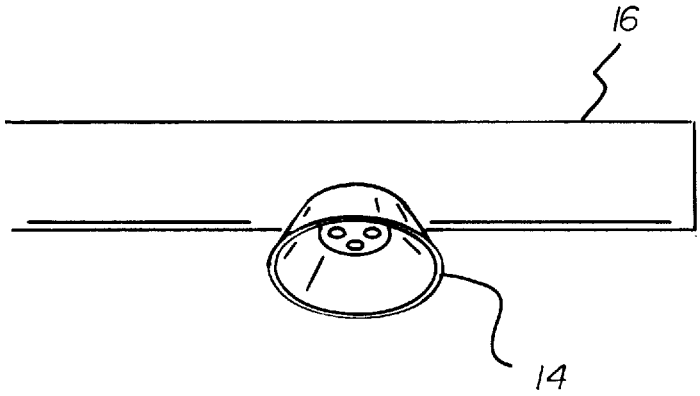
FIG. 3 is a schematic partial side view of a nozzle of the present invention.
Figure 4:
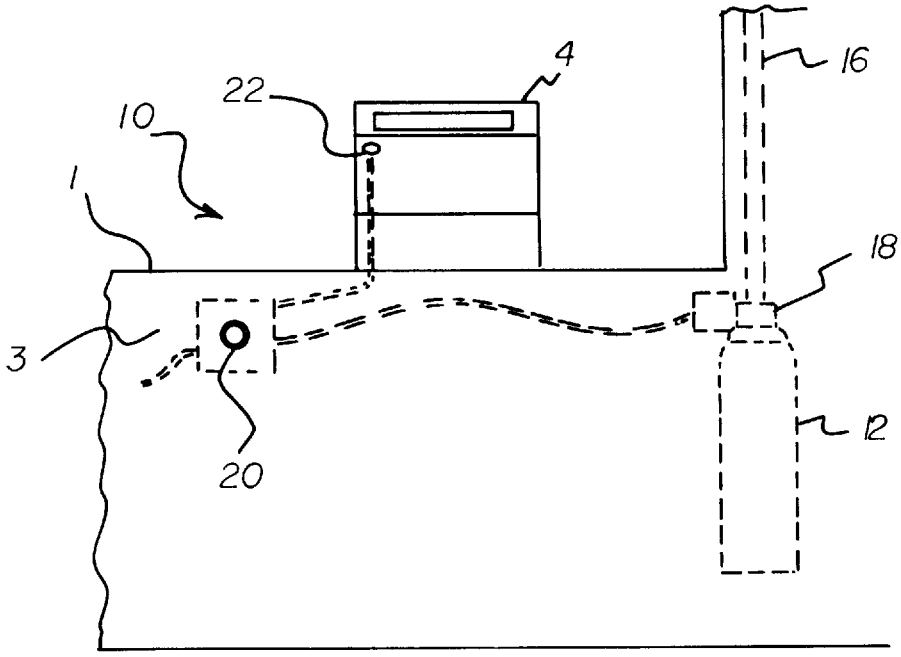
FIG. 4 is a schematic back side view of the present invention.

The personal defense spray delivery system is designed for delivering a spray of defensive chemical spray to an area so that a user may have at their disposal a non-lethal protective device. This invention may be used in combination with a typical counter structure 1 as illustrated in FIGS. 1,2,3 having a front 2 and a back 3. Typically a user is positioned adjacent the back 3 of the counter structure 1 while the threat is located adjacent the front 2 of the counter structure 1. With reference to the FIGS., the personal defense spray delivery system includes a reservoir 12 of a personal defense chemical, such as Mace or pepper spray. Preferably, the reservoir 12 is located in the counter structure 1.

At least one nozzle 14 is in fluid communication with the reservoir 12 by a pipe 16 system. FIG. 2 shows an illustrative personal defensive spray system having three nozzle 14*s*. The nozzle 14 is designed for delivering a spray of the personal defense chemical to an area. As illustrated in FIG. 1, the nozzle 14 is suspended above the counter structure 1 and is directed to deliver a spray towards an area in front 2 of the front 2 of the counter structure 1.

A delivery device 18 is provided for delivering the personal defense chemical from the reservoir 12 to the nozzle 14 when the delivery device 18 is activated. A first actuator 20 is operatively connected to the delivery device 18 and is designed for activating the delivery device 18. Preferably, the first actuator 20 is located at the back 3 of the counter structure 1 such that a user positioned behind the counter structure 1 may activate the delivery device 18. Ideally, the first actuator 20 comprises a push button-type actuator. It is even more preferable that the system includes a second actuator 22 operatively connected to the delivery device 18. This second actuator 22 is located on an object 4, such as a cash register, on the counter structure 1. Ideally, the second actuator 22 comprises a key lock-type actuator. This second actuator 22 permits a user positioned behind the counter structure 1 to activate the delivery device 18 to deliver a spray of chemical when their hands are positioned either on or near the object 4. For example, this second actuator 22 is extreme useful when a user is facing a threat that demands something from the object 4 on the counter, such as the money in a cash register. This way the user can easily delivery a spray without making any obvious movements.

In use, a user is generally positioned adjacent the back 3 of the counter structure 1. The user activates one of the actuators so that the delivery device 18 transmits a personal defense chemical from the reservoir 12 to the nozzle 14 where it is sprayed over an area. Optionally, the invention may be used in a vehicle, such as a taxi, where the actuators are located near the driver's seat and the nozzle 14 is located over the rear passenger seats of a vehicle. This way a threat to a driver from the passenger seats may be countered with a spray of personal defense chemicals to give the driver a chance to remove himself from the vehicle and away from the threat.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of he principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A personal defense spray delivery system for delivering a spray of defensive chemical spray in combination with a counter structure having a front and a back and being positioned adjacent a wall, said personal defense spray delivery system comprising:

a reservoir of a personal defense chemical positioned within the counter structure;

a plurality of nozzles each being in fluid communication with said reservoir, said nozzles being for delivering a spray of said personal defense chemical to an area, said nozzles being suspended above the counter structure, said nozzles being directed to deliver a spray in a generally downward direction towards an area in front of the front of the counter structure;

a delivery device for delivering said personal defense chemical from said reservoir to said nozzles when said delivery device is actuated;

a first actuator being operatively connected to said delivery device, said first actuator being for activating said delivery device, wherein said first actuator comprises a push button-type actuator, said first actuator being located on the back of the counter structure adjacent a top face thereof; and a second actuator being operatively connected to said delivery device said second actuator being for activating said delivery device, wherein said second actuator comprises a key locktype actuator, wherein the counter structure has an object thereon in the form of a cash register, said second actuator being located on the object on the counter structure;

wherein the nozzles are in fluid communication with said reservoir via a tube assembly that includes a vertically oriented lower tube positioned behind the wall and extending upwardly from a center line of the counter structure, a horizontally oriented intermediate tube having a back end coupled to a top end of the lower tube and extending adjacent the wall to a point substantially vertically aligned with the front of the counter structure, and a horizontally oriented overhead tube having an inboard end coupled to a front end of the intermediate tube and extending from the wall in substantial vertical alignment with the front of the counter such that the nozzles are positioned substantially directly above the front of the counter;

wherein the nozzles are substantially equally spaced along the overhead tube and each include a frusto-conical outer shell mounted on the overhead tube such that the outer shell opens downwardly for producing a spray of said personal defense spray in a downward direction in front of the front of the counter.

* * * * *